United States Patent [19]

Itoku et al.

[11] Patent Number: 4,992,107

[45] Date of Patent: Feb. 12, 1991

[54] METHOD OF MAKING HIGH VISCOSITY DETERGENT GEL

[75] Inventors: Ralph S. Itoku, Glendale Heights, Ill.; Terry M. Crowell, Twin Lakes, Wis.

[73] Assignee: Park Corporation, Barrington, Ill.

[21] Appl. No.: 440,704

[22] Filed: Nov. 24, 1989

Related U.S. Application Data

[63] Continuation-in-part of Ser. No. 266,588, Nov. 3, 1988, abandoned.

[51] Int. Cl.[5] ..... B08B 3/00; C11D 9/30; C11D 1/75; C11D 7/32

[52] U.S. Cl. ..... 134/27; 134/26; 134/28; 134/29; 252/117; 252/548; 252/558; 252/551; 252/DIG. 4; 252/DIG. 13

[58] Field of Search ..... 252/117, 548, DIG. 4, 252/DIG. 13, 558, 551; 134/26, 27, 28, 29

[56] References Cited

U.S. PATENT DOCUMENTS

| | | | |
|---|---|---|---|
| 3,808,156 | 4/1974 | Gorisch et al. | 252/545 |
| 3,954,676 | 5/1976 | Tuvell | 252/548 |
| 3,970,596 | 7/1976 | Klisch et al. | 252/545 |
| 4,414,144 | 11/1983 | Liebowitz et al. | 252/548 |
| 4,732,704 | 3/1988 | Biermann et al. | 252/548 |

FOREIGN PATENT DOCUMENTS

| | | |
|---|---|---|
| 151952 | 6/1953 | Australia . |
| 527522 | 7/1956 | Canada . |
| 232153 | 8/1987 | European Pat. Off. . |
| 87/06950 | 11/1987 | World Int. Prop. O. . |

*Primary Examiner*—Paul Lieberman
*Assistant Examiner*—Kevin McCarthy
*Attorney, Agent, or Firm*—McAndrews, Held & Malloy, Ltd.

[57] ABSTRACT

Gel dishwashing detergent compositions are prepared contaiing, by weight, from about 10% to 50% of one or more anionic surfactants, from about 8% to about 40% of a monoalkylolamide of a higher fatty acid, from about 3% to about 40% of a dialkylolamide of a higher fatty acid, and from about 10% to 50% water. A process for making the stable high viscosity detergent gel composition and avoiding phase separation is claimed.

13 Claims, No Drawings

METHOD OF MAKING HIGH VISCOSITY DETERGENT GEL

This application is a continuation-in-part of co-pending U.S. application Ser. No. 07/266,588 filed on Nov. 3, 1988, now abandoned.

TECHNICAL FIELD

The present invention relates to a high viscosity detergent gel composition containing specified amounts and types of surfactants, stabilizers, and thickeners especially useful in the washing of tableware, kitchenware, and other hard surfaces.

BACKGROUND OF THE INVENTION

Mixtures of surfactants are prepared and sold for a wide variety of industrial and domestic applications. They are often provided in liquid or solid form. It is desirable that the mixtures of surfactants contain as high a proportion of active material as possible. A detergent gel composition offers unique advantages over the use of liquid or solid concentrates. Unless the liquid concentrate is combined with viscosity modifiers, cosolvents, or other viscosity thinners, a gel generally can have a greater concentration of active ingredients compared to a liquid concentrate. Moreover, a gel is generally more active and dissolves at a more uniform rate compared to a solid concentrate.

A gel offers several advantages when used with detergent dispensing or metering apparatus. Details on the advantages and usefulness of gels with dispensers are disclosed in the contemporaneous filed patent application entitled "Gel Dispensing Wash Apparatus," invented by Terry M. Crowell, assigned U.S. patent application Ser. No. 07/318,619 by the Patent and Trademark Office, and incorporated herein by reference.

A persistent problem associated with many detergent gel compositions is that the gel compositions tend to undergo syneresis, or phase separation. It is an object of this invention to provide high viscosity detergent gel compositions and a process for making the same that simultaneously strongly resist syneresis and provide the surfactancy, sudsing, and mildness attributes of an acceptable detergent useful in washing of tableware, kitchenware, and other hard surfaces, as well as dispensing and metering benefits referenced to above.

SUMMARY OF THE INVENTION

The present invention comprises a high viscosity detergent gel composition containing by weight:

(a) from about 10% to 50% of one or more anionic surfactants;

(b) from about 8% to 40% of a monoalkylolamide of a higher fatty acid;

(c) from about 3% to 40% of a dialkylolamide of a higher fatty acid; and (d) from about 10% to 50% water.

The high viscosity detergent gel compositions of this invention can contain, if desired, any of the usual adjuvants, diluents, additives, chelating agents, fragrances, and the like without detracting from the advantageous properties of the composition.

The high viscosity detergent gel of the present invention is particularly well suited for use in detergent dispensing or metering devices.

In the process or method of making the gel composition of the invention, the acid neutralizing base is added to the water and mixed. Then, the anionic acids are added to the mixture slowly and mixed until completely reacted with the base to form the anionic surfactant slurry. In a separate steam jacketed kettle, the monoalkylolamide and the dialkylolamide are melted at 160° F. to form the thickening and stabilizing mixture. Then, the thickening and stabilizing mixture is added to the anionic surfactant slurry along with any desired adjuvents, diluents, additives, pH buffering agents or the like. The final mixture is heated from about 130° F. to 200° F. to remove air bubbles for packaging of the high viscosity detergent gel composition. In the alternative, the air bubbles can be removed by well-known vacuum techniques.

DETAILED DESCRIPTION OF THE INVENTION

The high viscosity detergent gel compositions of the present invention contain the following three essential components:

(a) one or more anionic surfactants;

(b) a monoalkylolamide of a higher fatty acid;

(c) a dialkylolamide of a higher fatty acid; and (d) water.

Optional ingredients and other surfactants can be added to provide various performance and aesthetic characteristics.

The high viscosity detergent gel compositions of the present invention are particularly well suited for use in detergent dispensing or metering devices such as those described in the copending patent application entitled "Gel Dispensing Wash Apparatus" invented by Terry M. Crowell, assigned Ser. No. 07/318,619 and incorporated herein by reference.

The gel compositions of this invention contain from about 10% to about 50% by weight of anionic surfactant or mixtures thereof. Preferred compositions contain about 20% to 30% of anionic surfactant by weight.

The anionic surfactants of this invention are generally the water soluble products formed by neutralizing certain sulfonic acids, sulfuric acids, phosphoric acids, or carboxylic acids with a base. The base may in each case conveniently be a hydroxide or carbonate of sodium, potassium, lithium or ammonium, or an amine, such as methylamine, dimethylamine, ethylamine, diethylamine, trimethylamine, diamine, propylamine, ethanolamine, diethanolamine or triethanolamine. Mixtures of the aforesaid bases may be used.

The acid which is neutralized may for example be an alkyl aryl sulfonic acid, an alkyl phosphoric acid or a sulfonated olefin, alkyl benzene, paraffin, carboxylic acid or carboxylic ester, or an acylated taurine or sarcosine or a sulphosuccinamate. In each case, the surfactant has at least one long chain alkyl group, the alkyl group or groups having an average of from 8 to 22 carbon atoms ("$C_8$–$C_{22}$") total.

Examples of the anionic surfactants are set forth in U.S. Pat. No. 4,492,646 as follows:

Anionic synthetic detergents which can form the surfactant component of the compositions of the present invention are the sodium, ammonium, potassium or magnesium alkyl sulfates, especially those obtained by sulfating the higher alcohols ("$C_8$–$C_{18}$") carbon atoms) sodium or magnesium alkyl benzene to alkyl toluene sulfonates, in which the alkyl group contains from about 9 to 15 carbon atoms ("$C_9$–$C_{15}$"), the alkyl radical being either a straight or branched aliphatic chain; sodium or magnesium paraffin sulfonates and olefin sulfonates in which the alkyl or alkenyl group contains from about 10 to about 20 carbon atoms ("$C_{10}$–$C_{20}$"); sodium $C_{10-20}$ alkyl glyceryl ether sulfonates, especially those ethers of alcohols derived from tallow and coconut oil; sodium coconut oil fatty acid monoglyceride sulfates and sulfonates; sodium, ammonium or magnesium salts of alkyl phenol ethylene oxide sulfates with about 1 to about 30 units of ethylene oxide per molecule and in which the alkyl radicals contain from 8 to about 12 carbon atoms ("$C_8$–$C_{12}$"); the reaction products of fatty acids esterified with isethionic acid and neutralized with sodium hydroxide where, for example, the fatty acids are derived from coconut oil; sodium or potassium salts of fatty acid amides of a methyl tauride in which the fatty acids, for example, are derived from coconut oil and sodium or potassium beta-acetoxy or beta-acetamidoalkanesulfonates where the alkane has from 8 to 22 carbon atoms ($C_8$–$C_{22}$).

Specific examples of alkyl sulfate salts which can be employed in the instant detergent compositions include sodium lauryl ether sulfate, sodium stearyl ether sulfate, sodium palmityl ether sulfate, sodium decyl sulfate, sodium myristyl ether sulfate, potassium lauryl ether sulfate, potassium stearyl ether sulfate, potassium decyl sulfate, potassium palmityl alkyl sulfate, potassium myristyl alkyl sulfate, sodium dodecyl sulfate, magnesium dodecyl sulfate, potassium tallow alkyl sulfate, sodium tallow alkyl sulfate, sodium coconut alkyl sulfate, potassium coconut alkyl sulfate, magnesium $C_{12-15}$ alkyl sulfate and mixtures of these surfactants. Preferred alkyl sulfates include sodium $C_{12-15}$ alkyl sulfates and magnesium $C_{12-15}$ alkyl sulfate.

Suitable alkylbenzene or alkyltoluene sulfonates include the alkali metal (lithium, sodium, potassium), alkaline earth (calcium, magnesium) ammonium and alkanolamine salts of straight or branched-chain alkylbenzene or alkyltoluene sulfonic acids. Alkylbenzene sulfonic acids useful as precursors for these surfactants include decyl benzene sulfonic acid, undecyl benzene sulfonic acid, dodecyl benzene sulfonic acid, tridecyl benzene sulfonic acid, tetrapropylene benzene sulfonic acid and mixtures thereof. Preferred sulfonic acids as precursors of the alkyl-benzene sulfonates useful for compositions herein are those in which the alkyl chain is linear and averages about 11 to 13 carbon atoms ($C_{11}$–$C_{13}$) in length. Examples of commercially available alkyl benzene sulfonic acids useful in the present invention include Conoco SA 515 and SA 597 marketed by the Continental Oil Company and Calsoft LAS 99 marketed by the Pilot Chemical Company. An example of commercially available alkyl aryl sulfonic acid is BioSoft S-100 marketed by Stepan Chemical Company.

The gel compositions of this invention contain from about 8% to about 40% by weight of a monoalkylolamide of a higher fatty acid. Preferred compositions contain about 15% to about 40% by weight of the monoalkylolamide. The monoalkylolamides serve as thickeners and stabilizers for the gel composition.

The gel compositions of this invention contain about 3% to about 40% by weight of a dialkylolamide of a higher fatty acid. Preferred compositions contain about 8% to about 40% by weight of the dialkylolamide. The dialkylolamide serves as a stabilizer and thickener for the gel composition. The monoalkylolamide and dialkylolamide function well in combination since the liquid dialkylolamide provides a medium for premelting the monoalkylolamide before adding them to the anionic surfactant slurry. The preferred viscosities of the present invention are from about 28,000 centipoise to about 60,000 centipoise and can be adjusted by altering the percentages of Mono- and dialkylolamides with increasing percentages resulting in high viscosity. The preferred ratio of Mono- to dialkylolamide is about 1–10:1.

As described in U.S. Pat. No. 4,530,775 and set forth herein, fatty acid alkylolamides, both the di- and the monoalkylolamides, are well known per se. They can be prepared in various ways, such as by condensation of fatty acids or esters thereof with an alkanolamine, or the reaction of alkylene oxide with a fatty acid amide. Depending upon the alkanolamine or alkylene oxide used and the amount thereof, optionally a catalyst, a reaction product is obtained containing predominantly a di- or monoalkylolamide, together with byproducts such as mono- and diester-amides, alkylolamine soaps, amine mono- and diesters, free alkanolamines, etc. A full discussion of these compounds, and their preparation is given in "Nonionic Surfactants," M. Schick, 1967, Chapters 8 and 12. The fatty monalkylolamides used in the present invention can be represented by the following formula:

$$R—CO—NH—R'—OH$$

in which R is a branched or straight chain $C_8$–$C_{24}$ alkyl radical, preferably a $C_{10}$–$C_{16}$ alkyl radical and R' is a $C_1$–$C_4$ alkyl radical, preferably an ethyl radical.

A typical and preferred example of a fatty acid monalkylolamide in the present invention is coconut fatty acid monoethanolamide (MONAMID CMA marketed by Mona Industries, Inc.), in which the coco fatty acid refers to the fatty acids predominantly present in coconut or palm-kernel oil. These fatty acids are predominantly $C_{12}$ and $C_{14}$ fatty acids. Other examples of monoalkylolamides include coconut fatty acid monoisopropanolamide, lauric acid monoethanolamide on monoisopropanolamide, stearic acid monoethanolamide and the like.

A typical and preferred example of a fatty acid dialkylolamide in the present invention is coconut fatty acid diethanolamide (Ninol 50 LL marketed by Stepan Chemical; Marlamid D1218). These fatty acids are predominantly $C_{12}$ to $C_{14}$ fatty acids. Other examples of dialkylolamides are lauric diethanolamide (e.g., Lankrostat JP marketed by Diamond Shamrock), myristic diethanolamide (e.g., Monamid 150 MW marketed by Mona Industries), and stearic diethanolamide (e.g., Monamid 718 marketed by Mona Industries).

The compositions of the invention may contain optional surfactants such as nonionic, ampholytic, zwitterionic, and cationic surfactants.

Nonionic synthetic surfactants may be broadly defined as compounds produced by the condensation of alkylene oxide groups (hydrophilic in nature) with an organic hydrophobic compound, which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. An example of an nonionic surfactant is nonyl-phenol 9.5 mole ethoxylate. The preferred concentration range for the nonionic surfactants of the present invention is from about 0% to about 5% by weight.

Ampholytic surfactants can be broadly described as derivatives of aliphatic amines which contain a long chain of about 8 to 18 carbon atoms ($C_8$–$C_{18}$) and an anionic water-solubilizing group, e.g. carboxyl, sulfo or sulfate. Examples of compounds falling within this definition are sodium-3-dodecylamino propane sulfonate, and dodecyl dimethylammonium hexanoate. The preferred concentration range for ampholytic surfactants in the present invention is from about 0% to about 10% by weight.

Zwitterionic surface active agents (in concentrations of 1% to 10% by weight) operable in the instant composition are broadly described as internally-neutralized derivatives of aliphatic quaternary ammonium and phosphonium and tertiary sulfonium compounds in which the aliphatic radical can be straight chain or branched, and wherein one of the aliphatic substituents contains from about 8 to 18 carbon atoms ($C_8$–$C_{18}$) and one contains an anionic water solubilizing group, e.g., carboxyl, sulfo, sulfato, phosphato, or phosphono.

Cationic surfactants such as quaternary ammonium compounds (in concentrations from 1% to 10% by weight) can find optional use in the practice of the invention to the extent they are compatible with the other surfactants in the particular composition.

Chelating agents (e.g. Hampene 100, CIBA/GEIGY) (tetrasodiumethylenediaminetetraacetic acid) may also be added in minor amounts 0.2% to 10% effective to minimize soap scum formation.

Minor but effective amounts of preservative (Formalin), fragrance (aviol lime), coloring agent (Ver Brill green, antimicrobial agents, and other additives, selected to be chemically-compatible with the above-described ingredients, can be included with the compositions of the present invention without detracting from the advantageous properties of the composition.

The composition of this invention contains water from about 10% to about 50% by weight, preferably from about 20% to about 30% by weight. The pH range preferred is between 7.3 and 8.7. Phosphoric or similar acid can be used to adjust the pH. The viscosity of the composition of this invention ranges from about 15,000 centipoise to about 60,000 centipoise at 77° F., preferably between about 28,000 centipoise and about 60,000 centipoise at 77° F.

The following example is given to illustrate the compositions of the invention. The following example is given by way of illustration only and in no way should be construed as limiting the invention in spirit or in scope, as many modifications and materials and methods will be apparent from this disclosure to those skilled in the art. All percentages are by weight unless otherwise indicated.

EXAMPLE 1

The following high viscosity detergent gel composition was prepared.

| | |
|---|---|
| Water | 24.0% |
| Caustic Soda (50%) | 5.8% |
| Sodium Xylene Sulfonate (SXS) | 4.0% |
| Chelating Agent (Hampene 100) | 0.2% |
| Alkyl Aryl Sulfonic Acid (BioSoft S-100) | 22.0% |
| Lauramine Oxide (Chemadox L) | 2.0% |
| Nonyl-phenol 9.5 Mole Ethoxylate (Sulfonic N95) | 1.0% |
| Sodium Alkyl Ether Sulfate (CS460) | 3.0% |
| Phosphoric Acid | 0.2% |
| Coconut Fatty Acid Monoethanolamide (Monamid CMA) | 19.0% |

-continued

| | |
|---|---|
| Coconut Fatty Acid Diethanolamide (Ninol 50LL) | 13.0% |
| Formalin | 0.1% |
| Ver Brill Green Coloring Agent | 0.004% |
| Avial Lime Perfume | 0.3% |
| UV Absorber (MS40) | 0.05% |

Soft water is placed in a main mixing tank. The caustic soda is added slowly to the water. Add the sodium xylene sulfonate and chelating agent and mix. To the mixture, add the alkyl aryl sulfonic acid slowly and mix until completely reacted. In a separate steam jacketed kettle, melt the coconut fatty acid monoethanolamide and coconut fatty acid diethanolamide at 160° F. Add the sodium alkyl ether sulfate, lauramine oxide and nonyl-phenol 9.5 mole ethoxylate to the main mixture tank and mix until completely dispersed and heat batch to 150° F. to 160° F.

Add approximately one half of the monoethanolamide and diethanolamide mixture to the main mixing tank and mix. Add one-fourth of the phosphoric acid to the main mixing tank. Premix the UV absorber, coloring agent in water and add to the main mixing tank along with the aviol lime perfume.

Add three-fourths of the total of the monoethanolamide and diethanolamide mixture to the main mixing tank and mix until completely dispersed (about 10 minutes). Thereafter, add water, and mix and take a sample and check specifications. More sodium xylene sulfonate, or coconut fatty acid monoethanolamide or diethanolamide may be needed to adjust the viscosity at 77° F. to between about 28,000 centipoise and 40,000 centipoise as measured using a Brookfield Viscometer with a #4 spindle (6 RPM), the refractive solids at 77° F. to between about 54% and 64% and to a specific gravity at 77° F. between about 0.91 and 0.93. Additional phosphoric or other acids may be used to adjust the pH to approximately pH 8.0.

Prior to packaging the composition, remove the entrapped air bubbles by either heating the composition from about 130° F. to about 200° F. or by using vacuum techniques.

The invention has been described with reference to various specific and preferred embodiments and techniques. However, it should be understood that many variations and modifications may be made while remaining within the spirit and scope of the invention.

What is claimed:

1. A process of making a high viscosity detergent gel composition which comprises the steps of:

(a) preparing an anionic surfactant slurry by neutralizing an acid containing at least one long chain alkyl group having an average of from 8 to 22 carbon atoms selected from the group consisting of sulfonic acids, sulfuric acids, phosphoric acids, and carboxylic acids with a base in water, said anionic surfactant slurry comprising from about 10% to about 50% by weight of said composition;

(b) preparing a monoethanolamide and diethanolamide mixture in a steam kettle by melting the monoethanolamide comprising from about 8% to about 40% by weight of said composition with the diethanolamide comprising from about 3% to about 40% by weight of said composition at 160° F.;

(c) adding the monoethanolamide and diethanolamide mixture to the anionic surfactant slurry;

(d) mixing at a speed sufficient to disperse said mixture until a substantially constant viscosity is obtained;

(e) adjusting the viscosity as necessary with anionic surfactants as prepared in step (a) or with monoalkanolamides and dialkanolamides as prepared in Step (b) from about 15,000 centipoise to about 60,000 centipoise; and (f) heating the mixture from about 130° F. to about 200° F. to remove entrapped air from said mixture, whereby a stable high viscosity detergent gel is produced consisting essentially of, by weight, from about 10% to about 50% of anionic surfactant, from about 8% to about 40% of monoalkanolamide, from about 3% to about 40% of dialkanolamide and from about 10% to about 50% water.

2. The high viscosity detergent gel composition of claim 1 further comprising an effective amount of one or more additives taken from the group consisting of fragrances, preservatives and antimicrobial agents.

3. The process according to claim 1 wherein in Step (a) said base is caustic soda and said acid is alkyl aryl sulfonic acid.

4. The process according to claim 1 wherein in Step (c) said monoalkanolamide is coconut fatty acid monoethanolamide and the dialkanolamide is coconut fatty acid diethanolamide.

5. The process of claim 1 wherein the ratio of monoethanolamide to dialkanolamide is about 1-10:1.

6. The process of claim 1 including the additional step of adjustment of the pH of said stable gel detergent with phosphoric acid from about 7.3 to about 8.7.

7. The process of claim 1 wherein a vacuum is applied to the composition to remove entrapped air bubbles.

8. A process of making a gel detergent composition which comprises the steps of:

(a) preparing a water and base solution sufficient for neutralizing an acid containing at least one long chain alkyl group having an average of from 8 to 22 carbon atoms selected from the group consisting of sulfonic acids, sulfuric acids, phosphoric acids, and carboxylic acids to form an anionic surfactant slurry comprising from about 10-50% by weight of said composition;

(b) preparing a monoethanolamide and diethanolamide mixture in a steam kettle by melting the monoethanolamide comprising from about 8-30% by weight of said composition with the diethanolamide comprising from about 3-25% by weight of said composition at 160° F.;

(c) adding the monoethanolamide and diethanolamide mixture to the anionic surfactant slurry and mixing at a speed sufficient to disperse said mixture;

(d) continuing said mixing while monitoring the viscosity until a substantially constant viscosity is obtained;

(e) adjusting the viscosity as necessary with anionic surfactants as prepared in Step (a) or with monoalkanolamide and dialkanolamides described in Step 2 from about 20,000 centipoise to about 30,000 centipoise;

(f) heating the mixture from about 130° F. to about 200° F. to remove entrapped air from said mixture, whereby a stable gel detergent is produced consisting essentially of, by weight, 10-50% of anionic surfactant, 8-30% of monoalkanolamide, 3-25% of dialkanolamide and 10-50% water.

9. The process according to claim 8 wherein in Step (a) said base is caustic soda and said acid is alkyl aryl sulfonic acid.

10. The process according to claim 8 wherein in Step (b) said monoalkylolamide is coconut fatty acid monoethanolamide and the dialkanolamide is coconut fatty acid diethanolamide.

11. The process of claim 10 wherein the ratio of monoethanolamide to dialkanolamide is about 1-10:1.

12. The process of claim 8 including the additional step of adjustment of the pH of said stable gel detergent with phosphoric acid to about 7.3 to 8.7.

13. The process of claim 8 wherein a vacuum is applied to the composition to remove entrapped air bubbles.

* * * * *